US010362844B2

(12) United States Patent
Bove et al.

(10) Patent No.: US 10,362,844 B2
(45) Date of Patent: Jul. 30, 2019

(54) MOVABLE DECORATIVE ELEMENTS

(71) Applicant: CHOPARD TECHNOLOGIES SA, Fleurier (CH)

(72) Inventors: Guy Bove, Versoix (CH); Richard Hiltbrunner, Petit-Lancy (CH)

(73) Assignee: CHOPARD TECHNOLOGIES SA (CH)

( * ) Notice: Subject to any disclaimer, the term of this patent is extended or adjusted under 35 U.S.C. 154(b) by 19 days.

(21) Appl. No.: 15/545,330

(22) PCT Filed: Jan. 28, 2016

(86) PCT No.: PCT/IB2016/000057

§ 371 (c)(1),
(2) Date: Jul. 21, 2017

(87) PCT Pub. No.: WO2016/120712

PCT Pub. Date: Aug. 4, 2016

(65) Prior Publication Data

US 2018/0000208 A1 Jan. 4, 2018

(30) Foreign Application Priority Data

Jan. 30, 2015 (CH) ..... 0112/15

(51) Int. Cl.
*A44C 17/02* (2006.01)
*A44C 17/04* (2006.01)
*G04B 47/04* (2006.01)

(52) U.S. Cl.
CPC ..... *A44C 17/0291* (2013.01); *A44C 17/04* (2013.01); *G04B 47/044* (2013.01); *G04B 47/046* (2013.01)

(58) Field of Classification Search
CPC . A44C 17/02; A44C 17/0241; A44C 17/0283; A44C 17/025; A44C 17/0291
USPC ..... 63/29.1, 31, 30
See application file for complete search history.

(Continued)

(56) References Cited

U.S. PATENT DOCUMENTS 6,324,869 B1 * 12/2001 Vanlioglu ..... A44C 17/0291 63/31
9,999,281 B2 * 6/2018 Dholakiya ..... A44C 25/001
2014/0102139 A1 * 4/2014 Barron ..... A44C 17/0208 63/26

FOREIGN PATENT DOCUMENTS

| | | |
|---|---|---|
| CH | 694111 | 7/2004 |
| DE | 9101425 U | 5/1991 |
| FR | 2757353 | 6/1998 |

* cited by examiner

*Primary Examiner* — Jack W Lavinder
(74) *Attorney, Agent, or Firm* — Galbreath Law Offices, P.C.; John A. Galbreath

(57) ABSTRACT

A movable decorative element, intended to be freely rotated and translated between two walls (5, 6) whose inner faces are parallel to each other, at least one of which is transparent, includes a precious or semi-precious stone (2) mounted in a socket (1). The socket (1) includes a closed bottom (4) whose outer face is bulged to promote the rotation of the decorative element when this bulged outer face (7) is applied against the inner face of one of said walls, and an open outer (7) opposite to the bottom (4) which is flush with or which protrudes relative to the stone (2) to form a bearing surface against the other of said walls (5, 6) when the decorative element is disposed between the two walls. The precious or semi-precious stone (2) is held in its socket (1) by a plurality of arms (3) which extend above a body (8) of the socket (1) and which crimp the stone (2), these arms (3) leaving, therebetween and above the body (8) of the socket (1), lateral openings (9) letting appear the flanks of the stone (2) between the arms (3), and said bearing surface is constituted by the free ends of said arms (3) in the form of separate contact areas spaced from each other around the periphery of the open outer face (7) of the socket (1).

19 Claims, 4 Drawing Sheets

MOVABLE DECORATIVE ELEMENTS

The present invention relates to movable decorative elements intended to be rotated and translated in jewellery items in particular rings and pendants, as well as utilitarian items decorated with movable decorative elements, in particular watches, spectacle frames, or luxury leather goods.

The quest for mobility of decorative elements in a timepiece or a piece of jewellery, when its user makes a movement and moves it offers a strong aesthetic effect and gives an additional visual attraction to the timepiece or the jewellery piece further showcasing it. It is known to have, around the dial of a timepiece or even above the latter, jewellery elements, such as stones, or even stones mounted in cabochons, which have at least one degree of freedom, in a channel or an enclosure in which these jewellery elements are movable.

U.S. Pat. No. 5,319,615 describes, at the periphery of the case and beyond the glass, an annular path closed by a transparent annulus, on which inserts forming signs defining linguistic elements may be displaced.

The patents EP0965071 ad CH609517 in the name of the applicant disclose a movable decorative element, according to the preamble of claim 1, intended to be freely rotated and translated between two walls whose inner faces are parallel to each other and at least one of which is transparent. This movable decorative element includes a precious or semi-precious stone mounted in a socket including a closed bottom whose outer face is bulged to promote the rotation of the decorative element when this bulged outer face is applied against the inner face of one of said walls. This socket further includes an open outer face opposite to the bottom which is flush or slightly protrudes relative to the stone to form a bearing surface against the other of said walls when the decorative element is disposed between the two walls.

CH609517 describes in particular movable decorative elements, in particular diamonds, mounted in supports in the form of small cylindrical sockets, whose outer face of the bottom is convex. This convex shape has been chosen in order to reduce the friction forces, improving the mobility of the support and then that of the movable decorative element. This rotational movement has an interesting scintillation effect since it showcases the scintillation effect given to diamond by its multiple facets.

EP0965071 describes, for its part, movable decorative elements disposed in a housing whose inner faces of the two walls of the housing are bulged along at least one radius of curvature with the aim of increasing the scintillation effect of the diamonds as movable decorative elements.

In all cases of the state of the art, the movable decorative element consists of precious or semi-precious stone held in a cylindrical-shaped socket whose cylindrical wall surrounds the stone and whose circular outer face forms a continuous bearing surface against the other of said walls as illustrated in FIG. 1 herewith.

The embodiments described in CH609517 and EP0965071 give full satisfaction and achieved a great commercial success due to a surprising effect obtained during the random rotation and translation of the precious stones.

The purpose of the present invention is to provide a movable decorative element, of the aforementioned type, configured so as to make the scintillation effect of diamonds even more spectacular.

In compliance with the invention, a movable decorative element, intended to be freely rotated and translated between two walls, includes a precious or semi-precious stone held in its socket by a plurality of arms which extend above a body of the socket and crimp the stone, these arms leaving therebetween and above the body of the socket lateral openings letting appear the flanks of the stone between the arms. Furthermore, said bearing surface is constituted by the free ends of said arms in the form of separate contact areas spaced from each other around the periphery of the open outer face of the socket, usually contact points for example.

Due to the separate contact areas spaced from each other around the periphery of the open outer face of the socket cooperating with the surface of a wall of the housing, it has been surprisingly noticed that the translational movement of the stone is accompanied with a longer rotation and which gives the impression that it rotates faster about itself, providing an even more surprising visual effect, moreover because the stone, almost entirely visible through the lateral openings of the rotating socket, gives the impression that it rotates alone without a support.

The socket according to the present invention thus highlights the scintillation effect given to the diamond by its multiple facets, accentuated by the increased visibility of the stone.

In a preferred embodiment, said arms of the socket and its closed bottom are made in one piece.

Preferably, said arms and said lateral openings are symmetrically disposed about the axis of the socket.

In one embodiment, the socket includes three arms however, in some variants, the socket may include four or five arms or even more.

Preferably, said arms are rounded sectional claws, thereby protecting in particular the stones during contacts between two movable elements between each other or between a movable element and a surface of the item in which the movable element is integrated.

Depending on the dimensions of the stone, the socket may include one or even two annulus parallel to the closed bottom, said arms extending from the bottom and above these annulus.

In order to better visualize the stone, the lateral openings of the socket occupy for example 40% or 60% of the periphery of the socket, preferably at least 75% or even 90% of the periphery of the socket (1). The larger the openings are, the more visible and highlighted the stone is.

Preferably, the socket in which the diamonds are mounted is made of precious metal, for example gold, generally used in jewellery for mounting diamonds. However, it is also possible to use other metals such as stainless steel, for example.

Different sizes of stones as well as various shapes of stones are provided. Thus, preferably, the precious or semi-precious stone and the socket have a corresponding shape, which is, inter alia, generally cylindrical, oval, square, triangular or asymmetric.

In a variant, the precious or semi-precious stone and the socket have a different shape.

For its application in a jewel or a watch for example, the movable decorative element is freely mounted in rotation and in translation between two walls of a decorative item whose inner faces are parallel to each other and at least one of which is transparent.

In order to be displaced when mounted in an item, a clearance is necessary between the walls whose inner faces are parallel and the height of the movable decorative element. The clearance between the height of the movable decorative element and the opposite inner faces of the walls may be comprised between 0.05 and 0.3 mm, and preferably between 0.05 and 0.1 mm.

In one embodiment, the two walls extend over a peripheral edge which delimits a free space for the free displacement in rotation and in translation of the decorative element(s).

In another embodiment, the two walls extend over two edges which delimit an annular path for the free displacement in rotation and in translation of the decorative element(s).

According to one feature of the decorative item according to the invention, the parallel inner faces of the walls are flat and according to another feature, the parallel inner faces of the walls are bulged.

In one modification of the decorative item according to the invention, the outer face of the bottom of the socket is flat and is applied against the bulged inner face of one of said walls, thereby promoting the rotation of the decorative element.

The features of the invention will appear more clearly on reading the description of several non-limiting embodiments given only by way of example, as well as an example of the state of the art, with reference to the schematic figures, in which.

Figure 1:
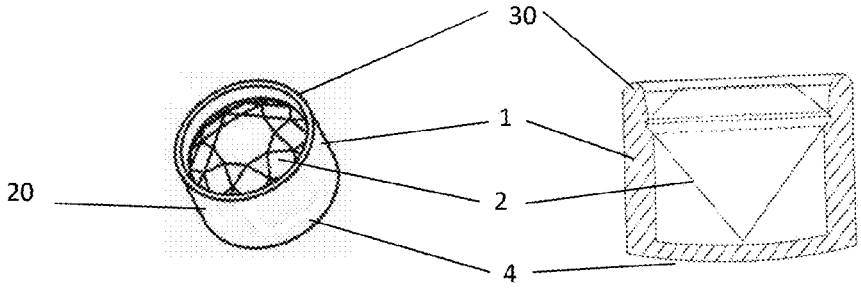
FIG. 1 shows a perspective view and a sectional view of a movable decorative element, according to the state of the art, intended to be freely rotated and translated between two walls.
Figure 2:
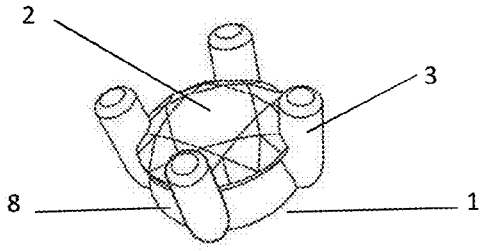
FIG. 2 shows a perspective view of a movable decorative element according to the invention intended to be freely rotated and translated between two walls, consisting of a socket with four arms and a round-shaped stone.

FIG. 1 illustrates a movable decorative element intended to be freely rotated and translated between two walls as described in CH609517 and EP0965071. These decorative elements consist of a cylindrical-shaped envelope 20, whose bottom 4 is slightly concave, having an annular groove for crimping a stone. The stone 2 is visible through the open upper portion opposite to the concave bottom 4 of the envelope 20. A continuous circular contact surface 30 surrounds the upper portion of the stone 2 and comes into contact with the glass.

According to the present invention and as illustrated in FIGS. 2 to 5, this embodiment of movable decorative element intended to be freely rotated and translated between two walls includes a precious round-shaped stone 2 mounted in a socket 1. The socket 1 includes, as known in the state of the art, a closed bottom 4 whose outer face is bulged to promote the rotation of the decorative element when this bulged outer face is applied against the inner face of one of said walls.

The precious stone 2 is held in its socket 1 by four arms 3 which extend over a body 8 of the socket 1 and crimp the stone 2. These four arms 3 leave therebetween and above the body 8 of the socket 1 lateral openings 9 letting appear the flanks of the stone 2 between the arms 3.

Figure 4:
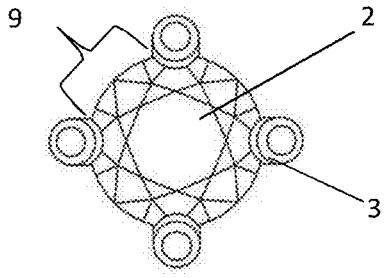
FIG. 4 shows a top view of the movable decorative element of FIG. 2.
Figure 5:
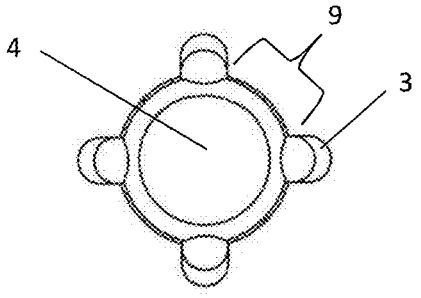
FIG. 5 shows a bottom view of the movable decorative element of FIG. 2.

The precious stone 2 and the socket 1 have a corresponding shape, round in this example (FIGS. 4 and 5). The socket 1 further includes an open outer face 7 and opposite to the bottom 4 which protrudes relative to the stone 2 to form a discontinuous upper bearing surface against the other wall 5 of said walls 5, 6 when the decorative element is disposed between the two walls.

According to the invention, a discontinuous bearing surface is constituted by the free ends of the arms 3 in the form of separate punctiform contact areas spaced from each other around the periphery of the open outer face 7 of the socket 1. Thus it is through these spaced contact areas that the socket 1 contacts the inner face of a wall 5 during the rotation of the decorative elements. Furthermore, due to these spaced contact areas, the socket has a longer rotation and faster appearance of the socket about itself.

Figure 3:
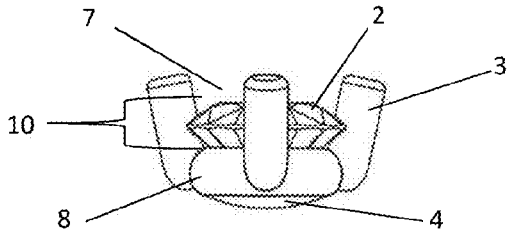
FIG. 3 shows a side view of the movable decorative element of FIG. 2.
Figure 3A:
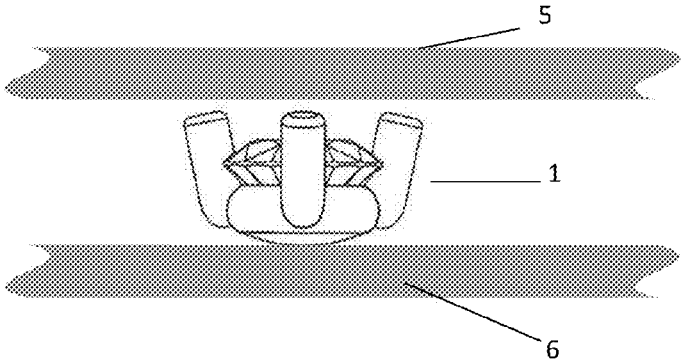
FIG. 3A shows a side view of the movable decorative element of FIG. 2 between the two walls.

As illustrated in FIG. 3A, the movable decorative element is disposed between two walls 5, 6 at least one of which is transparent. In this example, the upper wall 5 must be transparent for letting appear the stone 2 in its socket.

The four rounded sectional arms 3, and said lateral openings 9 are symmetrically disposed about the axis of the socket 1.

According to this embodiment, the round-shaped stone 2 may have different diameters, preferably comprised between 2 and 5 mm. The dimension between glasses is for example preferably comprised between 1.5 mm and 5.0 mm.

Figure 6:
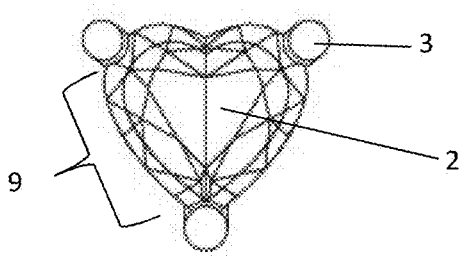
FIG. 6 shows a top view of a movable decorative element consisting of a socket with three arms and a heart-shaped stone.

In the embodiment illustrated in FIG. 6, a movable decorative element consists of a socket 1 with three arms 3 and a heart-shaped stone 2. The three rounded sectional arms 3 and the lateral openings 9 are regularly disposed about the axis of the socket 1.

Figure 7:
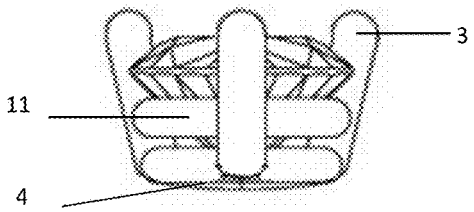
FIG. 7 shows a side view of the movable decorative element of FIG. 5, the socket including an intermediate annulus between the convex bottom of the socket and the end of the arms.

The socket 1 illustrated in FIG. 7 includes an open outer face 7 opposite to the bottom 4 which slightly protrudes relative to the stone 2. Furthermore, the socket 1 includes an annulus 11 parallel to the closed bottom 4, the arms 3 extending from the bottom 4 and above this annulus 11.

Figure 7A:
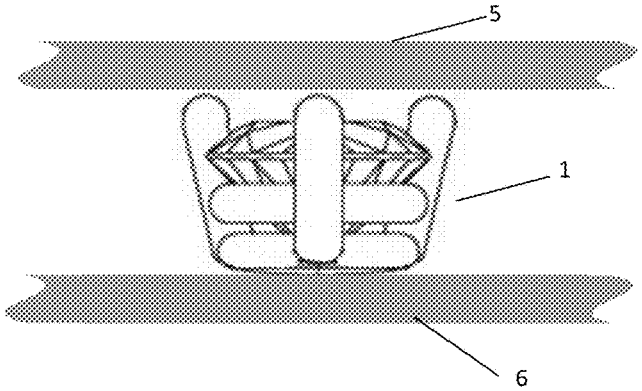
FIG. 7A shows a side view of the movable decorative element of FIG. 5 between two walls.

As illustrated in FIG. 7A, the movable element 7 is disposed between two parallel walls 5, 6. At least the upper wall 5 is transparent, but the two walls 5, 6 may be transparent, depending on the configuration of the decorative item in which the movable decorative element is mounted.

Figure 7B:
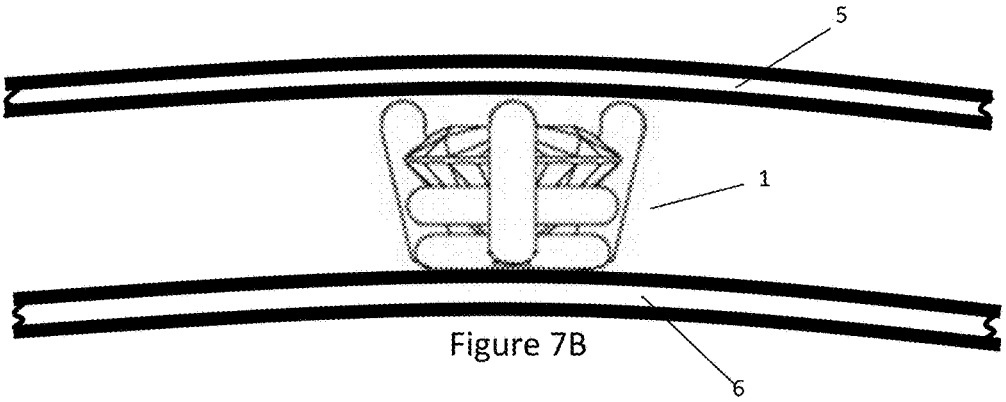
FIG. 7B is a similar view to FIG. 7A of a modification where the outer face of the bottom of the socket is flat and is pressed against a bulged wall.
Figure 7C:
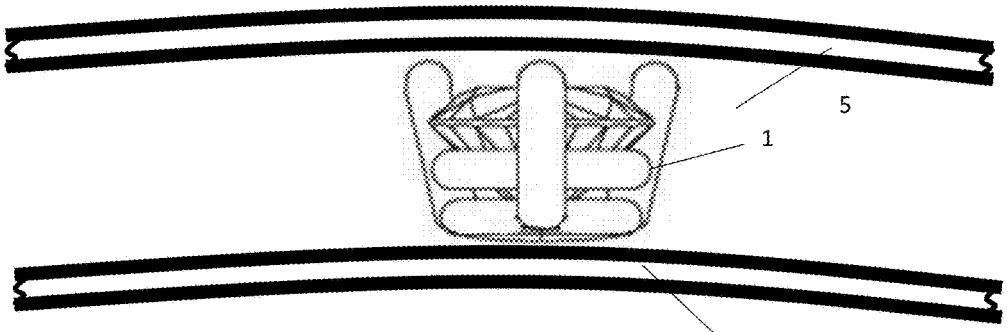
FIG. 7C is a similar view to FIGS. 7A and 7B but where the outer face of the bottom of the socket is bulged and is pressed against a bulged wall.

According to the modification of FIG. 7B, the movable element has a flat bottom and the glasses 5, 6 are bulged. In this case, it is the bulging of the glass which causes the rotation of the movable element.

Of course, FIG. 7B is only an example of a modified decorative item with a movable element with a flat bottom. The other embodiments of illustrated movable elements may also be modified by replacing the bulged bottom by a flat bottom pressed against a bulged wall.

In the illustrated embodiments, the lateral openings 9 occupy more than 75% or even 80% of the periphery of the socket 1. The sizes of the lateral openings 9 are adapted depending on the dimensions and the material of the socket 1, as well as on the size and the shape of the stone 2.

Figure 8:
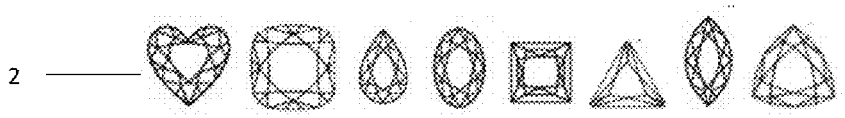
FIG. 8 shows a top view of stones intended to be mounted in the socket of a movable decorative element intended to be freely rotated and translated between two walls.

As illustrated in FIG. 8, different shapes of stones may be crimped in the socket 1 also called bezel. The stones 2 may be round-, heart-, square-, cushion-, triangular-, pear-, marquise-, oval- or rhomb-shaped. It is however not excluded to use other shapes of stones 2.

Figure 9:
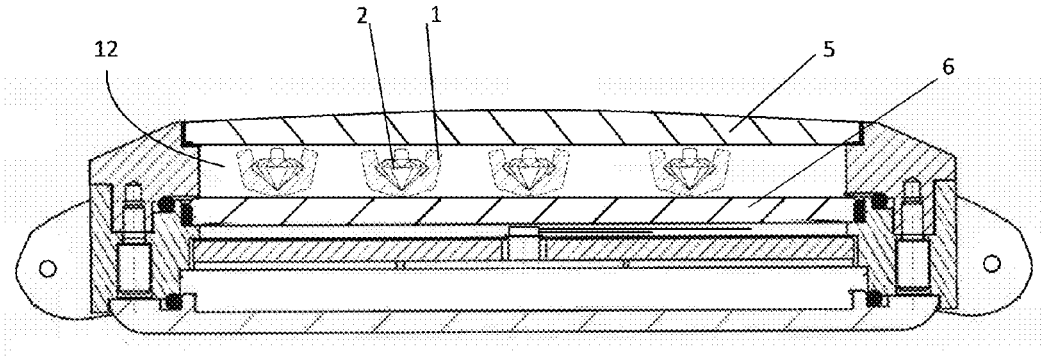
FIG. 9 shows a sectional view of a wristwatch into which are inserted, between two walls, four movable decorative elements.

In the embodiment illustrated in FIG. 9, a watch shown in sectional view includes a movement provided with a dial, housed in a case comprising a case middle closed, on the one hand by a bottom, and on the other hand by a glass 5. A second glass 6 is disposed between the glass 5 and a dial.

In this example, the respective inner faces of each glass 5 and 6 are applied against an area of the inner face of a case middle, arranging therebetween a free space 12 with predetermined height. In this example, the respective inner faces of the crystal 5, 6 are rigorously flat. In a non-illustrated variant, the respective inner faces of the glasses 5, 6 may have a slight bulging formed by one or more radii of curvature, around one or more center(s) or axis/axes of curvature, in particular along different section planes according to EP0965071. In this case, the respective given curvatures to these two inner faces 5, 6 are rigorously identical relative to each other, so as the height of the free space formed therebetween remains constant.

Alternatively as described according to EP0965071, taking into account the bulging of the face 6 of the free space 12, the outer face of the bottom 4 of the socket 1 might be flat or very slightly bulged, without canceling the rotation effect, but by reducing it meanwhile. However, this measure allows reducing the height of the socket 4 and consequently that of the free space 12 between the two glasses 5, 6 and thus that of the watch.

In order to avoid any consecutive displacement of the sockets 1 in the space 12 between the two glasses 5, 6, the inner surfaces of the glass 5 and 6 must be smooth and made of a material of suitable hardness that is non-scratchable.

Concerning the sockets 1 in which the diamonds 2 are mounted, they are preferably made of a precious metal, for example of gold, generally used in jewellery for mounting the diamonds. However, it is also possible to use other metals such as stainless steel, for example.

In the case where, as in the example illustrated in FIG. 9, the two walls 5, 6 delimiting a space 12 are formed of glasses, preferably made of sapphire or a material having a hardness comparable to that of sapphire. If the inner glass or a portion thereof, does not cover the dial, but for example is limited to an annular area disposed around the dial, only one side must be transparent. In this case, instead of a sapphire glass, the non-transparent wall may be made of another suitable material, for example a stone or ceramic.

In the example illustrated in FIG. 9, only the upper face of the glass 5 is bulged while in a variant, the two faces of the outer glass 5 are parallel and bulged. Having in particular a bulged outer glass 5 gives greater sturdiness thereto, so as its thickness may be reduced, allowing a thickness gain corresponding to the jewellery item, which is of particular importance for watches. Furthermore, a bulged glass also gives a magnifying effect.

The optional bulging of the wall, according to EP0965071, in order to obtain an effect on the rotation speed of the movable decorative elements is very low. Tests have shown that preferred values are located between 0.5 and 1 mm in concavity height for a crystal of 20 mm in diameter. A greater concavity height is possible, but with a much greater concavity height, the displacement of the diamond is tending towards being limited to the peripheral area of the space 12 delimited by the two walls 5, 6.

Furthermore, the walls may for example have a spherical bulging or a roll bulging (in a single axis).

The invention is not obviously limited to round glasses. It may also be applied to polygonal-shaped glasses, for example rectangular or square glasses.

The movement of the movable decorative elements in the space delimited by the two walls 5, 6 is purely random. The higher the rotation speed is, the slower the displacement in translation is and vice versa. The movable decorative elements can rotate in one direction or in the other according to the direction of the created torque to initiate the movement of these decorative elements. As this direction is quite random, when the space 12 between the two walls 5, 6 contains several movable decorative elements, that can rotate in different directions even longer, at different speeds appearing even faster and/or longer due to different points or contact areas separated from each other, thereby creating an even more surprising and spectacular effect.

In a non-illustrated variant, the two walls 5, 6 extend over two edges which delimit an annular path for the free displacement in rotation and in translation of the decorative element(s). For example, the movable elements may occupy a peripheral annular area around a dial.

Figure 10:
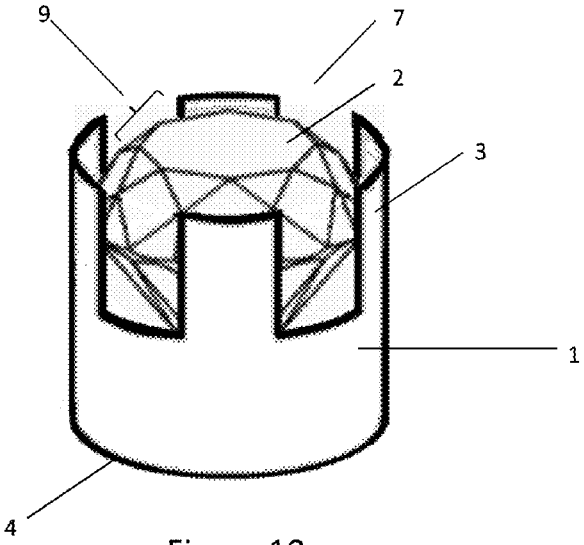
FIG. 10 shows a side view of a variant of a movable decorative element intended to be freely rotated and translated between two walls.

According to another embodiment of the invention illustrated in FIG. 10, a movable decorative element may be obtained from a cylindrical-shaped socket 1. This cylindrical-shaped socket 1 is then machined to have lateral openings 9. In this case, the contact points are replaced by areas or segments separated from each other and having a closed bottom 4 whose outer face is bulged to promote the rotation of the decorative element when this bulged outer face is applied against the inner face of one of said walls, and an open outer face 7 opposite to the bottom 4 which is flush relative to the stone to form circular segments forming bearing walls against the other of said walls 5, 6 when the decorative element is disposed between the two walls. This solution has in particular the advantage of being relatively easy to be provided.

As mentioned hereinabove, the invention is not limited to watches, but is applicable to all kinds of items in particular jewellery items such as rings and pendants, as well as spectacles or even pens or other instrument of writing. Items with movable decorative elements according to the invention might also be considered, associated with luxury leather items, such as handbags. In general, these movable decorative elements may be applied to any utilitarian item in order to associate an original aesthetic effect thereto. In particular, it is possible to include several decorative elements of different types in one item to provide a unique aesthetic effect.

The invention claimed is:

1. A decorative article comprising a movable decorative element which is freely mounted in rotation and translation between two walls (5, 6) whose inner faces are parallel to each other, at least one of which is transparent, the decorative element including a precious or semi-precious stone (2) mounted in a socket (1), the socket (1) including:

a closed bottom (4), having an outer face (7) which is applied in contact against the inner face of one of said walls, with one of the contacting faces bulged to promote the rotation of the decorative element, and an open outer face (7) opposite to the bottom (4) which is flush with or protrudes relative to the stone (2) to form a bearing surface against the other of said walls (5, 6), characterized in that the precious or semi-precious stone (2) is held in said socket (1) by a plurality of arms (3) integral with the socket (1) and extend above a body (8) of the socket (1) terminating at a free end, crimp the stone (2), the body (8) of the socket with said plurality of integral arms (3) being closed by said closed bottom whose outer face in contact with said inner face of the other of said walls promotes the rotation of the decorative element, said arms (3) leaving, therebetween and above the body (8) of the socket (1), lateral openings (9) which are rotatable with the socket (1) and which let appear flanks of the stone (2) between the arms (3) during rotation of the decorative element, and said bearing surface is constituted by free ends of said arms (3) in the form of separate contact areas spaced from each other around the open outer face (7) of the socket (1) about a periphery thereof, the free ends of said plurality of arms (3) being able to come to bear against the other of said walls when the decorative element rotates and translates between the two walls.

2. The decorative article according to claim 1, wherein said arms (3) are made in one piece with the socket (1) and its closed bottom.

3. The decorative article according to claim 1, wherein said arms (3) and said lateral openings (9) are disposed symmetrically about an axis of the socket (1).

4. The decorative article according to claim 1, whose socket (1) includes at least three arms (3).

5. The decorative article according to claim 1, wherein said arms (3) are rounded sectional claws.

6. The decorative article according to claim 1, whose socket (1) includes an annulus (11) parallel to the closed bottom (4), said arms (3) extending from the bottom (4) and above this annulus (11).

7. The decorative article according to claim 1, wherein the lateral openings (9) occupy at least 40% or 60% of the periphery of the socket (1), preferably at least 75% or even 90% of the periphery of the socket (1).

8. The decorative article according to claim 1, whose socket (1) is made of precious metal.

9. The decorative article according to claim 1, whose stone (2) is a precious stone, in particular a diamond.

10. The decorative article according to claim 1, wherein the precious or semi-precious stone (2) and the socket (1) have a corresponding shape which is, inter alia, generally cylindrical, oval, square, triangular or asymmetric.

11. The decorative article according to claim 1, wherein the bearing surface formed by the free ends of the arms (3) protrudes relative to an outer face of the stone (2).

12. The decorative article according to claim 1, wherein there is a clearance between the height of the socket (1) and the opposite inner faces of the walls (5, 6), which clearance ranges from 0.05 to 0.3 mm and preferably from 0.05 to 0.1 mm.

13. The decorative article according to claim 1, wherein the parallel inner faces of the walls (5, 6) are flat and the outer face of the closed bottom of the socket (1) is bulged.

14. The decorative article according to claim 1, wherein the parallel inner faces of the walls (5, 6) are bulged and the outer face of the closed bottom of the socket (1) is flat or bulged.

15. The decorative article according to claim 1, wherein the walls (5, 6) are made of sapphire or a material having a hardness comparable to that of sapphire.

16. The decorative article according to claim 1, wherein the two walls (5, 6) are transparent.

17. The decorative article according to claim 1, wherein the two walls (5, 6) extend over a peripheral edge which delimits a free space for the free displacement in rotation and in translation of the decorative element(s).

18. The decorative article according to claim 1, wherein the two walls (5, 6) extend over two edges which delimit an annular path for the free displacement in rotation and in translation of the decorative element(s).

19. The decorative article according to claim 1, in the form of a watch; a writing instrument; a jewel; a spectacle frame; or a leather item.

* * * * *